US006934972B2

(12) United States Patent
Desjardins et al.

(10) Patent No.: US 6,934,972 B2
(45) Date of Patent: Aug. 30, 2005

(54) ADJUSTABLE HELMET WITH DISABLING INSERT

(75) Inventors: André Desjardins, Dorval (CA); Stephen Goodhand, Kirkland (CA)

(73) Assignee: Itech Sport Products Inc., Kirkland (CA)

( * ) Notice: Subject to any disclaimer, the term of this patent is extended or adjusted under 35 U.S.C. 154(b) by 65 days.

(21) Appl. No.: 10/622,650

(22) Filed: Jul. 21, 2003

(65) Prior Publication Data

US 2005/0015857 A1 Jan. 27, 2005

(51) Int. Cl.[7] ..... A63B 71/10

(52) U.S. Cl. ..... 2/425; 2/418; 29/270; 29/278

(58) Field of Search ..... 2/410, 417, 418, 2/419, 425, 183; 254/104; 81/15.9; 294/49; 29/239, 270, 271, 281, 281.5, 278

(56) References Cited

U.S. PATENT DOCUMENTS 2,654,141 A * 10/1953 Nelson ..... 29/24.5
3,452,416 A * 7/1969 Claude et al. ..... 29/281.5
3,664,211 A * 5/1972 McConnell ..... 81/15.9
4,477,929 A 10/1984 Mattsson
4,539,715 A 9/1985 Clement
5,956,776 A 9/1999 Chartrand
6,298,539 B1 * 10/2001 Dissing ..... 29/426.5

FOREIGN PATENT DOCUMENTS

GB 2021470 A * 12/1979 ..... A42B/3/02

* cited by examiner

*Primary Examiner*—Rodney M. Lindsey
(74) *Attorney, Agent, or Firm*—Ogilvy Renault LLP; Guy J. Houle

(57) ABSTRACT

A removable flat flexible disabling insert is disposed between interengaging members which are provided for registry with one another in opposed displaceable surface portions of adjustable shell portions of an adjustable helmet. The disabling insert prevents interengagement of the interengaging members but permits adjustable displacement of the shell portions. The disabling insert, when removed, permits engagement of the interengaging members. Particularly, but not exclusively, the insert is used with a hockey helmet having front and back adjustable shell portions.

20 Claims, 3 Drawing Sheets

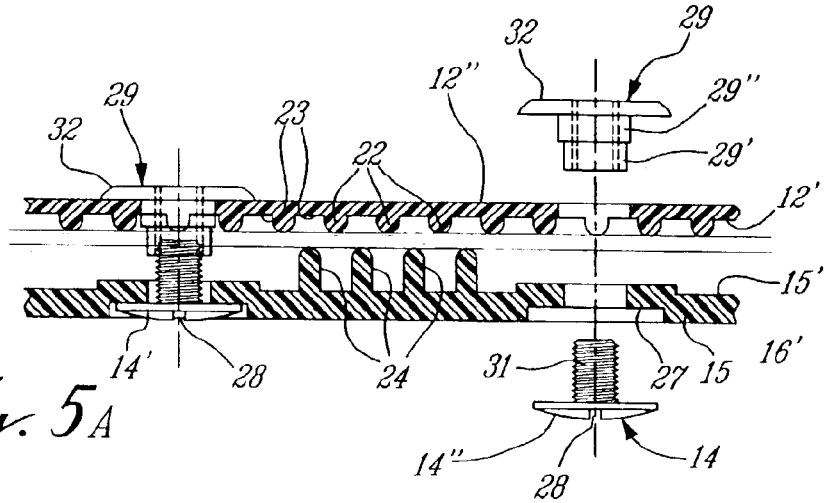
Fig. 5A
Fig. 5B
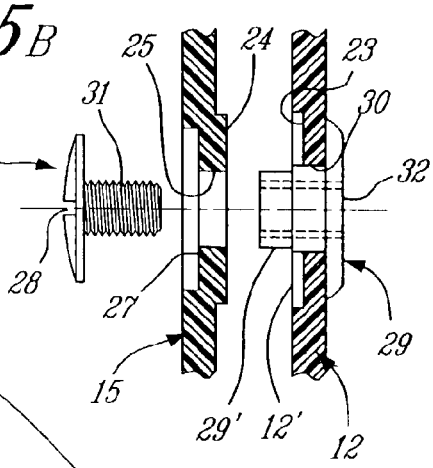
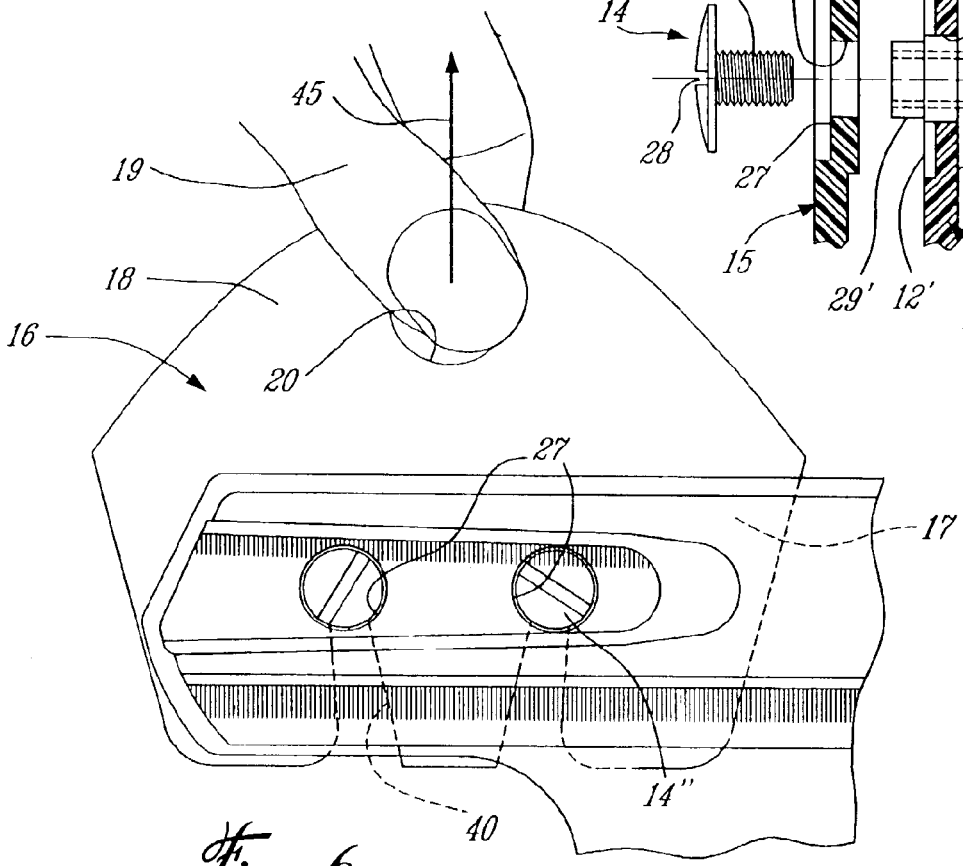
Fig. 6

ADJUSTABLE HELMET WITH DISABLING INSERT

TECHNICAL FIELD

The present invention relates to adjustable helmets having front and back adjustable shell portions provided with complementary connectors which can be clamped together with the shell portions adjusted to a wearer's head and more specifically to a disabling insert which permits adjustment of a helmet on a wearer's head at the point of sale of the helmet.

BACKGROUND ART

Adjustable helmets are known and examples of these are described in U.S. Pat. Nos. 4,477,929, 4,539,715 and 5,956,776. Usually, these helmets are formed of two shell portions, namely, front and back shell portions which are interconnected together by engaging members such as ribs formed in overlapping regions of the front and back shell portions and on opposed sides of the helmet. The usual practice is to purchase the helmet and adjust it on one's head by the intended user by simply disabling the connectors and positioning the shell portions for close fit on the head and then enabling the connectors.

It is desirable to provide a means wherein the helmet can be adjusted to a person's head at the point of sale and usually by trained personnel. Therefore, there is a need to facilitate this adjustment without having to disassemble the helmet. There is also a need to provide a connector which is easily and quickly engageable.

With the above-referenced prior art there is disclosed the use of wedging elements to facilitate the activation of the connectors. The problem with these wedging elements is that they become easily disconnected particularly if the wearer hits a solid object, such as ice, side boards and side board Plexiglas surfaces or people collide with one another during a sports activity, such as hockey. A further disadvantage of the above-mentioned prior art is that often it is required to remove screws to adjust and connect the shells together. Screws are desirable as they provide a more reliable interconnection. However, it is difficult for a person to adjust the helmet on his head as the screws are not visible to him. Therefore, the helmet must be removed and the screws tightened and this is a tedious and often improper way of adjusting the helmet shell portions.

SUMMARY OF INVENTION

It is therefore a feature of the present invention to overcome the above-mentioned disadvantages of the prior art and to fulfill the above required need to make the adjustment simple, quick and reliable without the need to remove connecting screws.

According to the above feature, from a broad aspect, the present invention provides a removable flat flexible disabling insert which is adapted to be disposed between interengaging members provided for registry with one another in opposed displaceable surface portions of adjustable shell portions of an adjustable helmet whereby to prevent interengagement of the interengaging members but permitting adjustable displacement of the shell portions. The disabling insert, when removed, permits engagement of the interengaging members.

According to a further broad aspect of the present invention there is provided an adjustable helmet which comprises front and back shell portions. The front and back shell portions are movable relative to one another along guide means. Adjustable engagement means is provided and constituted by interengaging members positioned for registry with one another in opposed displaceable surface portions of the shell portions. Shell clamping means is provided to urge and retain the interengaging members of the shell portions in arresting relationship to prevent displacement of the shell portions. A removable disabling insert is disposed between the shell portions and in obstructing relationship between the interengaging members in the opposed displaceable surfaces to prevent the clamping means to urge the interengaging members in arresting relationship while permitting adjustable displacement of the shell portions. The removable disabling insert when removed permits the arresting relationship of the interengaging members with the shell portions disposed at a desired position relative to one another.

BRIEF DESCRIPTION OF DRAWINGS

A preferred embodiment of the present invention will now be described with reference to the accompanying drawings in which:

FIG. 5A is a top section view showing the position of the interengaging members of the front and back shell portions with the disabling insert disposed therebetween and also showing the connectors associated with the slots, one in an engaged position and the other in an exploded view position;

FIG. 5B is a sectional side view showing the construction of the bolt fastener connectors and the position of the ribs constituting the interengaging members; and FIG. 6 is a side view showing the position of the disabling insert relative to the connectors and interengaging ribs and the method of use.

DESCRIPTION OF PREFERRED EMBODIMENTS

Figure 1:
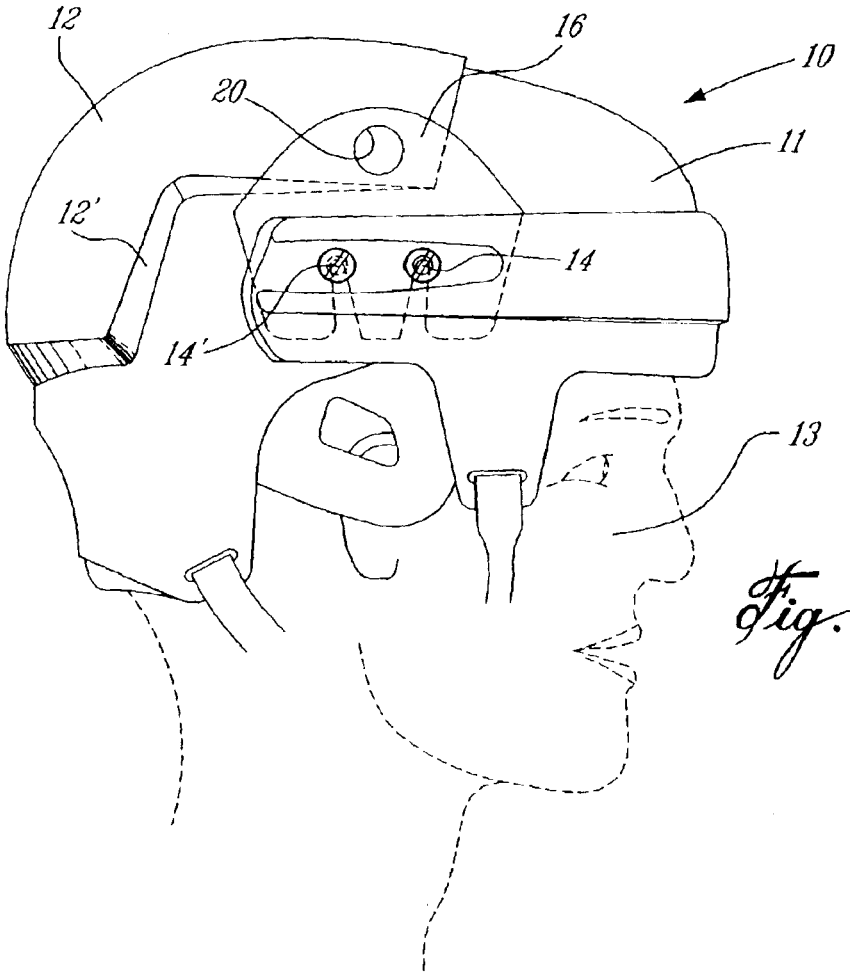
FIG. 1 is a side view of a hockey helmet fitted with the disabling insert of the present invention.

Referring now to the drawings, and more particularly to FIG. 1, there is shown generally at 10, an adjustable helmet which is comprised of a front shell portion 11 and a rear shell portion 12 which are adjustably displaceable with respect to one another to provide proper fitment on a wearer person's head 13. As hereinshown, a pair of connector bolts 14 and 14' are provided in a rearwardly extending connecting arm 15 formed integral with the front shell portion 11 and disposed on opposed sides of the adjustable helmet 10. Only one side is hereinshown in FIG. 1.

Located behind the connecting arms 15 there is provided an adjustable engagement means which will be described hereinafter and the present invention is constituted by a disabling insert 16 which is removably positioned between the connecting arms 15 and an outer surface 12' of the rear shell portion 12 whereby to disable the adjustable engagement means thereby permitting the shells to be displaced relative to one another while on the intended wearer's head 13 with the connector bolts in place.

Figure 2:
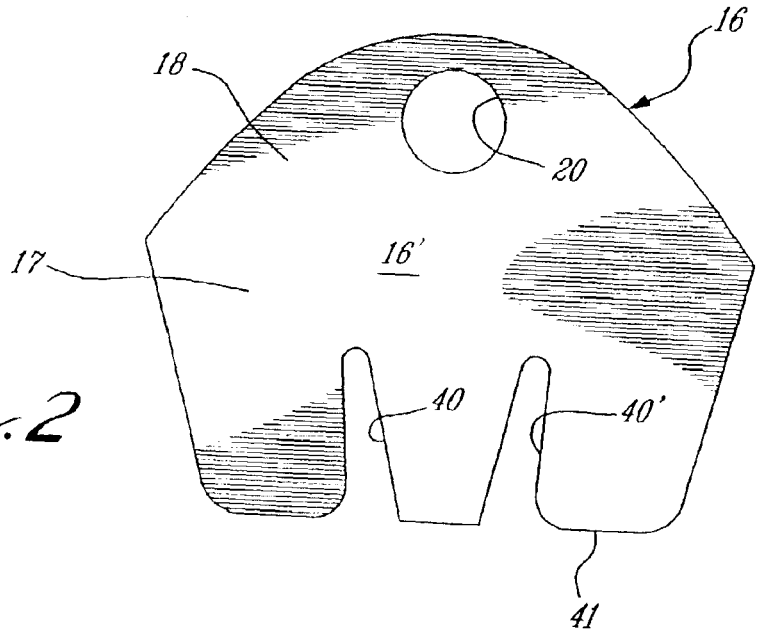
FIG. 2 is a side view, slightly in perspective, illustrating the construction of the disabling insert.

As shown in FIG. 2, the disabling insert 16 is formed from a flat flexible plastic sheet material having a connector obstructing portion 17 and a finger grasping portion 18 to permit positioning and removal of the disabling insert between interengageable members of the adjustable engagement means. The finger grasping portion 18 constitutes an extension tab which is readily accessible to the fingers 19 of a person, as shown in FIG. 6, to position and remove the disabling insert. A through hole 20 is provided to facilitate grasping of the tab by the fingers.

Figure 3:
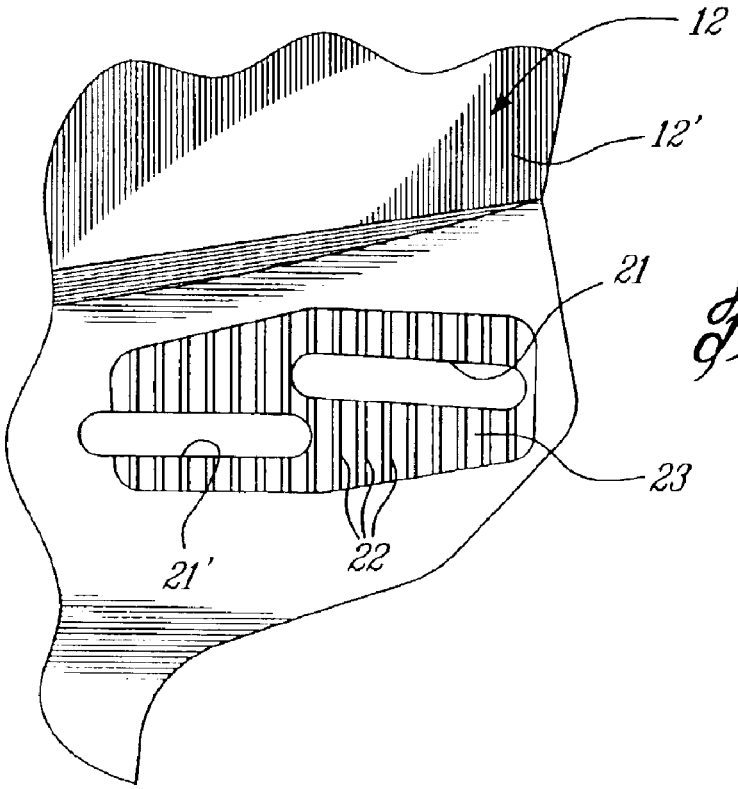
FIG. 3 is a fragmented side view illustrating the construction of the interengaging member disposed on opposed sides of the back shell portion.

With reference now to FIGS. 3 to 5B, there will be described the adjustable engagement means. As shown in FIG. 3, there is provided on the outer surface 12' of the rear shell 12, one or more, herein a pair, of guide slots 21 and 21' and a connector means disposed about the slots. The connector means is constituted by a plurality of equidistantly spaced ribs 22 disposed in side-by-side parallel relationship and defining troughs or valleys 23 therebetween. This rib formation is provided on opposed sides of the rear shell in identical locations. The slots 21 and 21' are elongated slots of equal length and define the maximum displacement between the front and rear shell portions.

Figure 4:
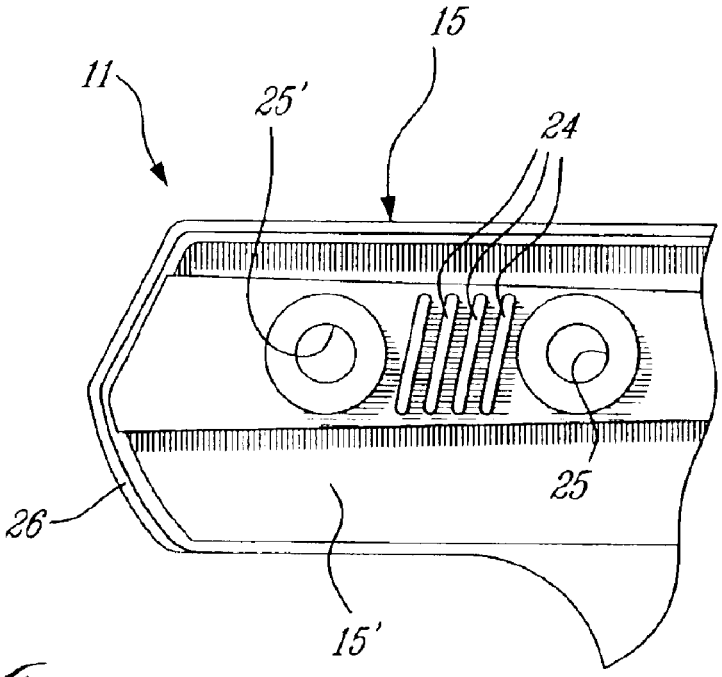
FIG. 4 is a fragmented view showing the construction of the interengaging member disposed on opposed sides of the front shell portion and disposed for registry with the interengaging member of FIG. 3.

As shown in FIG. 4, the connector arms 15 of the front shell portion 11 are provided on an inner surface 15' thereof with one or more connecting ribs 24 which have the same spacing as the ribs 22 and are receivable in selected ones of the troughs 23 formed between the ribs 22 in the rear shell portion when locked therein by clamping means, which is constituted by the connecting bolts 14 and 14'. On opposed sides of these connecting ribs 24, there is provided a through bore 25 and 25' to receive the connecting bolts 14 and 14' respectively. The connecting arms 15 are reinforced arms provided with integrally formed ribs such as contour rib 26 and other formations as is well known in the art, and this connecting arm 15 has an outer recess 27 to receive the head 14" of the connecting bolt 14, as shown in FIG. 5A, to protect the connector head to prevent accidental disengagement. The connector head 14 has a slot 28 formed therein for engagement by a screwdriver tool. The connector also comprises a female part 29 having a threaded shaft 29' and a collar 29" having opposed flat parallel sections 30, as shown in FIG. 5B, for positioning the collar 29'" in close fit within a respective one of the guide slots 21 and 21'. The female connector has an enlarged flat head 32 which sits over the inner surface 12" of the rear shell portion. The threaded rod 31 of the bolt 14 is threadably received within the threaded shaft 29 to urge the inner surface 15' of the connecting arm 15 against the outer surface 12' of the rear shell portion whereby the connecting ribs 21 can be urged into opposed troughs 23 of the connector formation formed about the slots.

It is pointed out that these shell portions are provided with a thick inner protective hard foam material padding and these fasteners do not come into contact with the wearer's head.

Referring now to FIGS. 2, 5A and 6, the disabling insert 16 is hereinshown as having passage means in the form of two spaced-apart vertical slots 40 and 40' extending upwardly from a bottom edge 41 of the insert. These slots are open ended slots and have a slight inner taper for ease of insertion, as herein illustrated. The spacing between the slots 40 and 41 is equivalent to the spacing between the bores 25 and 25' which receive the pair of connecting bolts 14 and 14' whereby the disabling insert 16 can be positioned, as shown in FIG. 5A, between the inner surface 15' of the connector arms 15 and the outer surface 12' of the rear shell portions and in obstruction between the connecting ribs 24 and the troughs 23 formed in the connector formation on the rear shell. Accordingly, the connector bolts 14 and 14' cannot cause engagement of the interengageable members.

As shown in FIG. 5A, connector 14' is shown secured to the connector portion 29, but only partly secured. Accordingly, with this disabling insert 16 in its position as shown in FIG. 5A, the shell portions are displaceable with respect to one another as the ends of the ribs 24 and the ribs 22 will slide over the opposed slippery surfaces 16' of the insert 16 permitting sliding adjustment. Once proper adjustment of the shell has been made on the wearer person's head 13, the insert 16 is pulled out in the direction of arrow 45, as shown in FIG. 6 by grasping the tab portion 18 of the insert with the fingers 19. The bolt fastener heads 14" are then tightened to cause the ribs 24 to enter into the troughs 23 and prevent relative displacement between the two shell portions.

It is pointed out that these helmets are packaged by the manufacturer with the disabling insert in position and the connecting bolts 14 and 14' are fastened to an extent that it permits the shell portions to slide relative to one another. At the point of sale, a service person can adjust the helmet on a purchaser's head. All that is required is simply to place the helmet on the intended wearer's head, as shown in FIG. 1, and adjust the shell to a comfortable position as dictated by the intended wearer and then the disabling insert is removed and the screws tightened. The insert is then discarded and is recyclable having been constructed of plastics material. It is, of course, obvious that these inserts can be supplied to the merchandiser who can easily fit them on the specific adjustable helmet in question and then re-use these inserts.

It is within the ambit of the present invention to cover any obvious modifications of the preferred embodiment described herein, provided such modifications fall within the scope of the appended claims.

We claim:

1. An adjustable helmet comprising front and back shell portions, said front and back shell portions being movable relative to one another along guide means, adjustable engagement means constituted by interengaging members are positioned for registry with one another on opposed displaceable surface portions of said shell portions, shell clamping means to urge and retain said interengaging members of said shell portions in arresting relationship to prevent displacement of said shell portions, and a removable disabling insert is disposed between said shell portions and in obstructing relationship between said interengaging members in said opposed displaceable surfaces to prevent said clamping means to urge said interengaging members in arresting relationship while permitting adjustable displacement of said shell portions, said removable disabling, when removed, permitting said arresting relationship of said interengaging members with said shell portions disposed at a desired position relative to one another.

2. An adjustable helmet as claimed in claim 1 wherein said adjustable engagement means are provided on opposed sides of said helmet, there being a removable insert associated with a respective one of said adjustable engagement means.

3. An adjustable helmet as claimed in claim 2 wherein said guide means is constituted by one or more guide slots formed in a respective one of said opposed sides of said helmet and in one of said opposed displaceable surfaces, and a connector means extending through a respective one of said one or more guide slots for interconnecting said shell portions together.

4. An adjustable helmet as claimed in claim 3 wherein said connector means is a connector bolt having a female part with a threaded shaft provided with an enlarged head portion which is greater than the width of said guide slots, said head portion having a slot receiving portion to prevent axial rotation of said threaded shaft but permitting said shaft to be displaced along said guide slot, and a threaded bolt having a tool engaging head for threaded engagement in said threaded shaft, said female threaded shaft being associated with an inner one of said shell portions and said threaded bolt being associated with an outer one of said shell portions, said tool engaging head being accessible on an outer surface of said outer one of said shell portions.

5. An adjustable helmet as claimed in claim 3 wherein said interengagement members are disposed in close proximity to said guide slots.

6. An adjustable helmet as claimed in claim 5 wherein said interengagement members comprise a plurality of equidistantly spaced ribs disposed in side-by-side parallel relationship and defining troughs therebetween and formed in one of said opposed displaceable surfaces, and one or more connecting ribs having the same spacing disposed in the other of said displaceable surfaces and being receivable in selected ones of said troughs when said clamping means displaces the ribs in said arresting relationship.

7. An adjustable helmet as claimed in claim 6 wherein said plurality of equidistantly spaced ribs are disposed as a group of ribs formed over and about said guide slot of an inner one of said shell portions, said inner shell being said back shell portion.

8. An adjustable helmet as claimed in claim 7 wherein there are two of said slots disposed in said opposed sides of said helmet, said slots being offset from one another, each slot having an associated one of said connector means.

9. An adjustable helmet as claimed in claim 8 wherein said connector means is a connector bolt having a female part with a threaded shaft provided with an enlarged head portion which is greater than the width of said guide slots, said head portion having a slot receiving portion to prevent axial rotation of said threaded shaft but permitting said shaft to be displaced along said guide slot, and a threaded bolt having a tool engaging head for threaded engagement in said threaded shaft, said female threaded shaft being associated with an inner one of said shell portions and said threaded bolt being associated with an outer one of said shell portions, said tool engaging head being accessible on an outer surface of said outer one of said shell portions.

10. An adjustable helmet as claimed in claim 9 wherein an outer one of said shell portions is said front shell portion, said front shell portion having opposed reinforced rearwardly extending connecting arms each provided with two spaced through bores for receiving a respective one of said threaded bolt therethrough with said tool engaging head being held captive in recesses formed about said through bores in an outer surface of said connecting arms.

11. An adjustable helmet as claimed in claim 3 wherein said removable insert is a flat flexible disabling insert member having passage means adapted for guiding displacement about said connector means to permit said insert member to be interposed between said interengagement members in said opposed displaceable surface portions.

12. An adjustable helmet as claimed in claim 11 wherein said disabling insert member is provided with finger grasping means to permit positioning and removal of said disabling insert member between said interengagement members.

13. An adjustable helmet as claimed in claim 12 wherein said finger grasping means is constituted by an extension tab formed integral with said flat flexible insert member and extending out of said opposed displaceable surface portion for easy access thereto.

14. An adjustable helmet as claimed in claim 13 wherein said extension tab is provided with a through hole therein to facilitate grasping.

15. An adjustable helmet as claimed in claim 12 wherein said insert member is a flat flexible thin sheet plastic member having opposed slippery surfaces.

16. A removable flat flexible disabling insert for use with an adjustable helmet, said insert being a flat flexible member adapted to be disposed between interengaging connector members provided for registry with one another in opposed displaceable surface portions of adjustable shell portions of said adjustable helmet to prevent engagement of said interengaging connector members but permitting adjustable displacement of said shell portions, said disabling insert having finger grasping means adapted to project between said interengaging members to permit positioning and removal of said disabling insert member, said disabling insert when removed permitting engagement of said interengaging members.

17. A removable flat flexible disabling insert as claimed in claim 16 wherein said removable insert having passage means adapted for guiding displacement about said interengaging connector members to permit said insert member to be interposed between said interengagement connector members in said opposed displaceable surface portions about said interengaging members.

18. A removable flat flexible disabling insert as claimed in claim 16 wherein said finger grasping means is constituted by an extension tab formed integral with said flat flexible insert member and extending out of said opposed displaceable surface portion for easy access thereto.

19. A removable flat flexible disabling insert as claimed in claim 18 wherein said extension tab is provided with a through hole therein to facilitate grasping.

20. A removable flat flexible disabling insert as claimed in claim 19 wherein said insert member has opposed slippery surfaces.

* * * * *